United States Patent [19]

Schell

[11] 4,229,921

[45] Oct. 28, 1980

[54] APPLIANCE DOOR DECORATOR PANEL CONSTRUCTION

[75] Inventor: Paul F. Schell, Newton, Iowa

[73] Assignee: The Maytag Company, Newton, Iowa

[21] Appl. No.: 964,840

[22] Filed: Nov. 30, 1978

[51] Int. Cl.[2] ..... E04C 1/40; A47B 43/00

[52] U.S. Cl. ..... 52/506; 312/204; 312/257 A; 312/257 SM; 126/190

[58] Field of Search ..... 52/506, 500, 511, 502; 49/486; 126/190, 200; 312/204, 213, 257 A, 257 SM; 85/80

[56] References Cited

U.S. PATENT DOCUMENTS

| | | | |
|---|---|---|---|
| 2,328,757 | 9/1943 | Tinnerman | 126/190 |
| 2,720,683 | 10/1955 | Schwenker et al. | 312/257 A |
| 2,958,911 | 11/1960 | Given et al. | 52/803 |
| 3,267,930 | 8/1966 | Casciani | 126/200 |
| 3,294,461 | 12/1966 | Barnard et al. | 312/213 |
| 3,766,700 | 10/1973 | Nuss | 52/502 |
| 3,830,134 | 8/1974 | Erickson | 85/80 |
| 3,855,994 | 12/1974 | Evans et al. | 126/200 |

*Primary Examiner*—James L. Ridgill, Jr.
*Attorney, Agent, or Firm*—Richard L. Ward

[57] ABSTRACT

A decorator panel construction is provided which utilizes removable and replaceable decorative panel inserts. A support panel holds these panel inserts between forwardly projecting upper and lower horizontal flanges. The panel inserts are further retained on the support panel by a pair of vertically extending elongated side channels secured to the support panel. The subassembly of support panel, panel insert and side channels, is secured to the appliance door by fasteners not visible from the front or sides of the appliance.

11 Claims, 6 Drawing Figures

APPLIANCE DOOR DECORATOR PANEL CONSTRUCTION

BACKGROUND OF THE INVENTION

Prior art door panels for appliances designed to utilize a decorative insert generally provide a polished metal or stainless steel "picture frame" construction which attaches to a special back-up panel. The back-up panel in turn attaches to the door of the appliance. This construction generally utilizes a plurality of threaded fasteners for securing the "picture frame" to the back-up panel. The heads of these fasteners are usually visible at least from the side of the appliance. In at least one construction an additional member is snapped into place following the attachment of the "picture frame" to cover the head portion of the threaded fasteners.

SUMMARY OF THE INVENTION

It is therefore an object of the instant invention to provide an improved decorator panel construction for an appliance.

It is a further object of the instant invention to provide an improved method of constructing and securing a decorator panel subassembly to an appliance door.

It is a still further object of the instant invention to provide a simplified appliance door decorator panel construction with a reduced number of parts.

Briefly, the instant invention achieves these objects in a decorator panel construction for an appliance door. A support panel has a lower flange for holding a decorator panel insert and further has rearwardly spaced generally vertically extending side flanges. Generally vertical side channels are located on each side of the support panel with a front lip spaced from the front surface of the support panel to receive the panel insert therebetween and to retain the insert on the support panel. The side channels also have rearwardly extending side surfaces and rear flanges overlapping and generally mating with the side flanges of the support panel. Fasteners engage the side flanges of the support panel and the rear flanges of the side channels to secure the side channels to the support panel for forming a decorator kit subassembly of the support panel and side channels. The fasteners are formed to facilitate attachment of the subassembly to the appliance door.

Operation of the apparatus and further objects and advantages thereof will become evident as the description proceeds and from an examination of the accompanying three pages of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
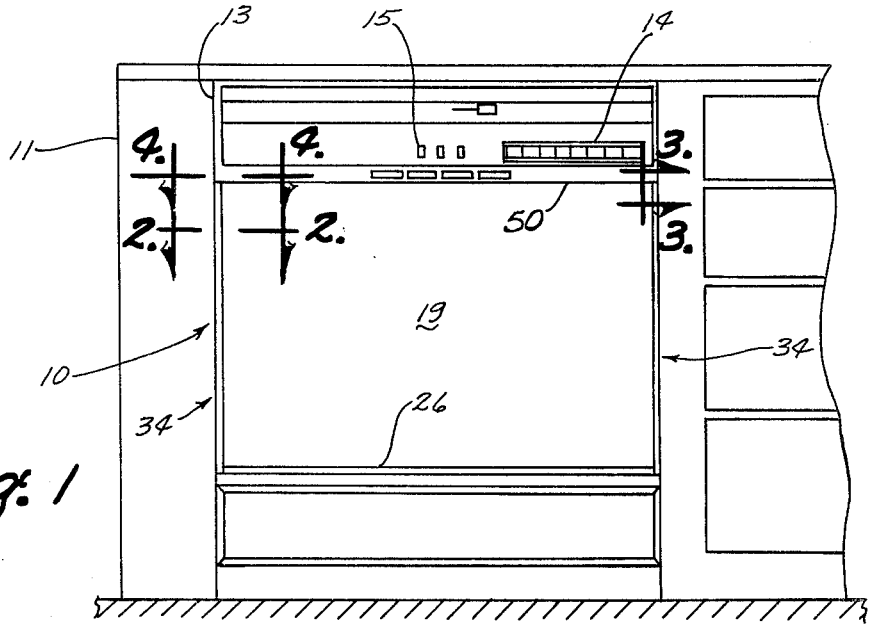
FIG. 1 is a front elevation of a dishwashing appliance.

Referring to the drawings there is shown in FIG. 1 a dishwasher 10 mounted within appropriate kitchen cabinetry 11. The dishwasher 10 includes a front-opening door for closing and sealing a dishwashing chamber.

Also, as shown in FIG. 1, the top portion of the door includes a control panel 13 for housing various control members such as push button switches 14, indicator lights 15 and sequence control means for operating the dishwasher 10 through a sequence of washing, draining and drying operations.

Figure 2:
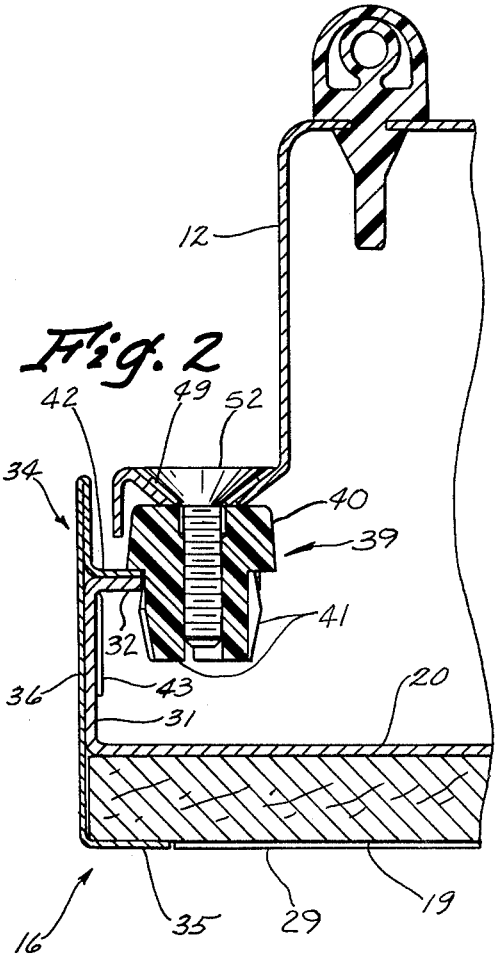
FIG. 2 is a section view taken generally along lines 2—2 of FIG. 1 showing attachment of the decorator panel insert subassembly to the appliance door.

The door assembly in this particular embodiment includes a decorator panel insert subassembly 16 secured to the dishwasher interior or inner door panel 12 as in FIG. 2. This decorator panel insert subassembly 16 is interchangeable with a standard equipment painted sheet metal front panel. The decorator panel insert subassembly 16 utilizes decorative panel inserts 19 generally formed from glass, plastic, plywood, hardboard or wooden paneling.

Figure 3:
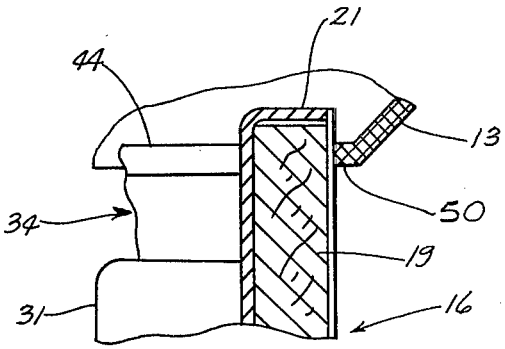
FIG. 3 is a sectional view taken generally along lines 3—3 of FIG. 1 showing the decorator panel insert subassembly captured by the control panel.
Figure 4:
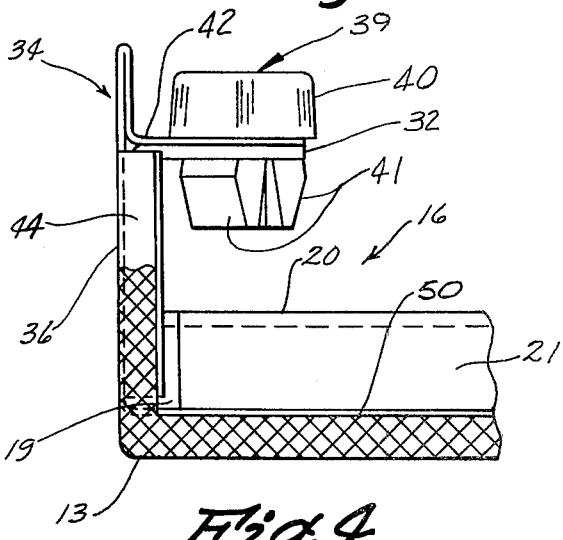
FIG. 4 is a fragmentary sectional view taken generally along lines 4—4 of FIG. 1.
Figure 5:
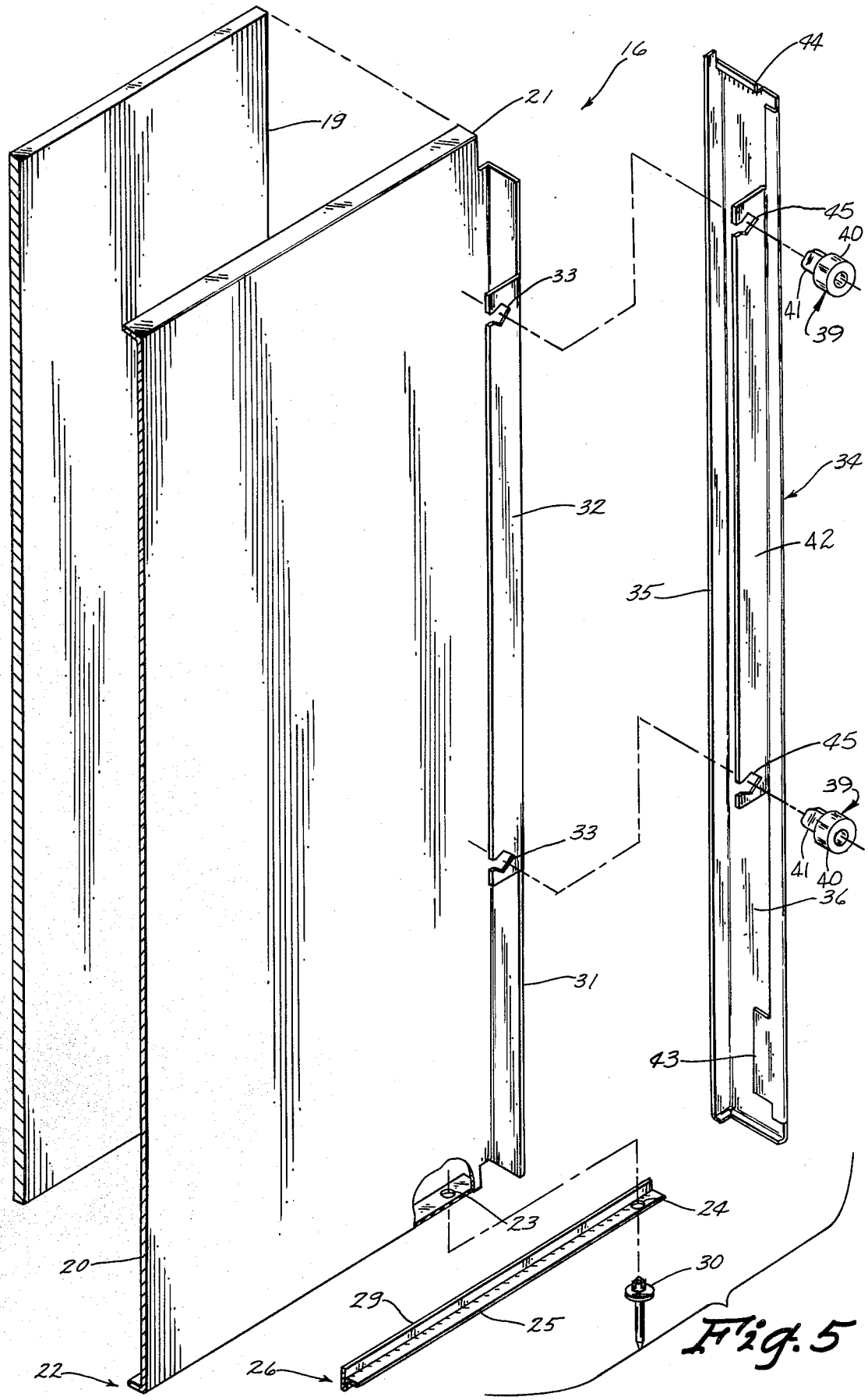
FIG. 5 is a partial pictorial view showing the assembly of the decorator panel insert subassembly.

Turning specifically to FIGS. 2–5, there is shown the component assembly of a decorator panel insert subassembly 16 which is attachable to the inner door 12 of a dishwasher 10 or other appliance. FIG. 5 shows the rear side of a back-up or support panel 20 which is the base component for building the decorator panel insert subassembly 16. The support panel 20 is formed from a sheet of steel or other suitable sheet material and includes a plurality of flanges at its top, bottom and sides. As further indicated in FIG. 5, the top and bottom flanges 21 and 22 are bent in a forward direction and extend horizontally to define the vertical limits for the decorative panel insert member 19.

The bottom flange 22 of the support panel 20 includes a first plurality of apertures 23 which are alignable with a second plurality of apertures 24 in the horizontal lip 25 of a lower trim strip 26. The lower trim strip 26 is formed of stainless steel or other suitable material and also includes a vertically displaced lip 29 generally perpendicular to the horizontal lip 25. The first and second apertures 23 and 24 in the bottom flange 22 and in the horizontal lip 25 are aligned and the lower trim strip 26 is secured to the bottom flange 22 with a plurality of blind rivets 30. After this assembly, the bottom flange-lower trim strip 25 and 26 combination forms an upwardly opening, horizontally extending U-shaped channel approximately the thickness of decorative panel inserts 19 and with the vertical lip 29 of the bottom trim strip 26 providing a decorative border for the bottom of the decorator panel insert subassembly 16.

As previously mentioned, and as best shown in FIG. 5, the support panel 20 further includes a pair of rearwardly extending vertically disposed side flanges 31. These flanges 31 each include an inwardly extending secondary flange portion 32 parallel to the plane of the support panel 20 but spaced rearwardly therefrom by the depth of the side flanges 31 to position the support panel 20 forward from the inner door 12. Each of these inwardly extending secondary flange portions 32 includes a pair of substantially square holes 33 usable in attaching the decorator panel insert subassembly 16 to the inner door panel 12 of the appliance as shown in FIG. 2 and which will be further discussed herein.

FIGS. 2, 4 and 5 show the assembly of a pair of side channels 34 to the support panel 20 and the fastening of the decorator panel insert subassembly 16 to the inner door 12 of the appliance. The side channels 34 are formed from stainless steel or other suitable material and extend in a vertical direction to decoratively cover the edges of the support panel 20, the panel inserts 19 and the inner door 12. The side channels 34 provide an imperforate front lip 35 and side surface 36, a rear flange portion 42, an elongated tab member 43 associated with the inside of the side surface 36 and an inwardly turned horizontal ledge member 44 located at the upper extremity of the side surface 36.

As further indicated in FIG. 2, the imperforate front lip 35 of the side channel 34 wraps around and overlaps the front of the panel insert 19 and the imperforate side surface 36 extends rearwardly at substantially 90° to the front lip 35 to decoratively cover the side of the support panel 20 and the side of the appliance inner door 12 when installed thereon. At this most rearward point, the side surface 36 is folded back on itself, as shown in FIGS. 2 and 4, and is brought forward to a position where the rear flange portion 42 of the side channel 34 is formed. This flange 42 is in a plane generally parallel to that of the front lip 35 of the side channel 34. The side channel rear flange 42 is contiguous with and is connected to the inwardly extending secondary flange portion 32 of the support panel side flange 31 when installed as shown in FIGS. 2 and 4 and as will be further discussed herein. The rear flange 42 contains a pair of substantially square holes 45 which are alignable with the square holes 33 in the inwardly extending portion 32 of the support panel side flanges 31.

As best shown in FIG. 5, the lower inside portion of the side channel side surface 36 includes an elongated tab member 43 formed from that portion of the side surface 36 which is folded back upon itself. This tab member 43 is spaced from the inside of the channel side surface 36 by the material thickness of the support panel 20. When the side channel 34 is assembled to the side flange 31 of the support panel 20 the tab member 43 straddles the lower end of the side flange 31 as shown in FIG. 2 and retains the lower portion of the side channel 34 in position relative to the support panel 20 and the panel insert 19.

When the panel insert 19 has been placed on the support panel 20 and the side channels 34 positioned, the support panel 20 and channels 34 are secured to each other at the flanges 32 and 42 by plastic screw grommets 39. The flanges 32 and 42 are held in this contiguous arrangement to form the decorator panel insert subassembly 16. The plastic screw grommets 39 have a head portion 40 which spaces the assembly 16 from the appliance door 12 and a pair of legs 41 which snap into the mating square holes 33 and 45 to secure the flanges 32 and 42 to each other.

The subassembly 16 is positioned on the inner appliance door 12 with the inwardly turned ledge 44, as in FIG. 4, fitting under the lower edge or lip 50 of the control panel 13 casting to trap the top ends of the side channels 34. The upper front portion of the decorator panel insert subassembly 16 is retained behind the lower portion of the control panel 13 as shown in FIG. 3. Thus, the panel insert 19 is secured all around its periphery in a decorative frame-like fashion by the lower edge or lip 50 of the control panel 13 on top, the lower trim strip 26 at the bottom and by the two side channels 34.

The decorator panel insert subassembly 16 is secured to the inner appliance door 12, as in FIG. 2, by a plurality of threaded fasteners 52 with cushion washers 49 protecting the surface of the inner door 12. The fasteners 52 extend through the apertures in the inner door panel 12, tap into the plastic screw grommets 39 and expand the legs 41 to lock the grommets 39 in place.

Figure 6:
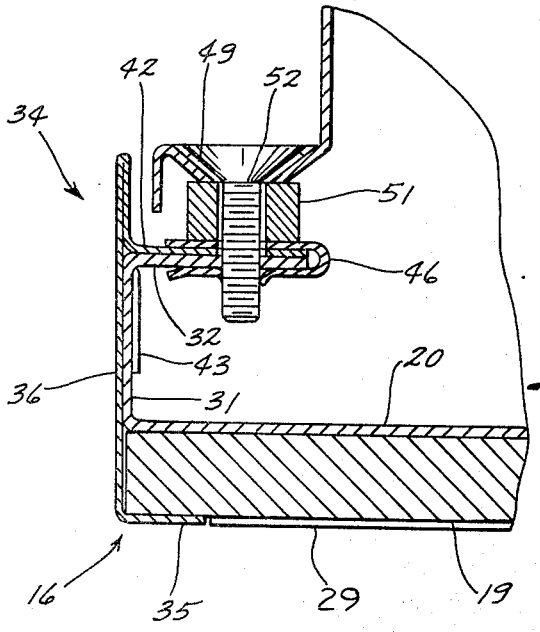
FIG. 6 is a sectional view similar to FIG. 2 showing an alternate fastener embodiment.

Although the preferred embodiment of the instant invention shows specific fasteners used in specific locations, it is anticipated that several alternate equivalent fasteners could be appropriately used in these locations to fulfill the fastening function. Examples of such locations are the use of blind rivets 30 for securing the lower trim strip 26 to the bottom flange 22 of the back-up panel 20 and the use of plastic screw grommets 39 for joining the side channels 34 to the support panel 20. It is further anticipated that another embodiment of the instant invention might utilize flanges formed in such a manner as to eliminate the need for the spacing function of the head portion 40 on the grommet 39. Also, it is deemed possible, as shown in FIG. 6, to use a spring clip type fastener 46 in conjunction with a spacer 51 to secure the flanges 32 and 42 and to properly space the insert subassembly 16 from the appliance door 12. Also, a spacer could be designed which would combine the features of the spacer 51 and the cushion washer 49 and which would remain in position on the appliance door 12 when the subassembly 16 is disassembled from the appliance door 12.

It is also noted that, while the preferred embodiment of the invention shows the side channels 34 and the lower trim strip 26 rolled from stainless steel stock, it is anticipated that these members could be fabricated from other materials and by other processes.

The instant invention thus provides a unique decorator panel insert subassembly 16 for an appliance door. The decorator panel insert subassembly 16 is fastened to the inner door 12 of the appliance without revealing any means of fastening from the front or sides of the appliance. The top, sides and bottom of the panel insert subassembly 16 are securely framed and locked in place by the combination of the control panel 13, side channels 34 and the lower trim strip 26.

In the drawings and specification, there has been set forth a preferred embodiment of the invention and although specific terms are employed these are used in a generic and descriptive sense only and not for purposes of limitation. Changes in form and proportion of parts as well as the substitution of equivalents are contemplated as circumstances may suggest or render expedient without departing from the spirit or scope of the invention as further defined in the following claims.

I claim:

1. A decorator kit subassembly for an appliance door, the combination comprising: a support panel having lower flange means for supporting a decorator panel insert and further having rearwardly spaced generally vertically extending side flange means including an inwardly turned rear flange portion in a generally vertical plane; generally vertical side channel means on each side of said support panel having a front lip spaced from the front surface of said support panel to receive said panel insert therebetween and to retain said panel insert on said support panel, a rearwardly extending side surface, and an inwardly turned rear flange means disposed in a generally vertical plane parallel to the plane of said rear flange portion of said support panel side flange means in overlapping and generally mating contact therewith; and fastener means engaging the rear flange portion of the side flange means of said support panel and the rear flange means of said side channel means to secure said side channel means to said support panel for forming a decorator kit subassembly of said support panel and said side channel means, said fastener means including integral means to facilitate attachment of said subassembly to said appliance door.

2. A decorator kit subassembly as defined in claim 1 wherein said fastener means comprises plastic screw grommets for securing said flanges in said subassembly.

3. A decorator kit subassembly as defined in claim 1 wherein said fastener means comprises spring clip fasteners for securing said flanges in said subassembly.

4. A decorator panel subassembly for an appliance door, the combination comprising: a decorative panel insert; a support panel having lower flange means for supporting said panel insert and further having rearwardly spaced generally vertically extending side flange means including an inwardly turned rear flange portion in a generally vertical plane; generally vertical side channel means on each side of said support panel having a front lip overlapping said panel insert to retain said panel insert on said support panel, a rearwardly extending side surface, and an inwardly turned rear flange means disposed in a generally vertical plane parallel to the plane of said rear flange portion of said support panel side flange means in overlapping and generally mating contact therewith; and fastener means engaging the rear flange portion of the side flange means of said support panel and the rear flange means of said side channel means to secure said side channel means to said support panel for forming a decorator panel subassembly of said support panel, panel insert and side channel means, said fastener means including integral means to facilitate attachment of said subassembly to said appliance door.

5. A decorator panel subassembly as defined in claim 4 wherein the side surface of said side channel means includes an elongated tab member engageable with a segment of said side flange means to lock the lower portion of said side channel means to said support panel.

6. A door assembly for a dishwasher having a front opening, the combination comprising: an inner door panel for closing said front opening; an intermediate panel spaced outwardly from said inner door panel by generally vertically extending side flange means on said intermediate panel with said side flange means including an inwardly turned rear flange portion in a generally vertical plane; an outer panel supported on said intermediate panel; a pair of substantially vertically extending channel members at the sides of said intermediate panel and having inwardly turned rear flange means disposed in a generally vertical plane parallel to the plane of said rear flange portion of said intermediate panel side flange means in overlapping and generally mating contact therewith and further having an imperforate front lip portion overlapping said outer panel to retain said outer panel on said intermediate panel; first fastener means for securing the rear flange means of said pair of channel members to the rear flange portion of the side flange means of said intermediate panel to form a subassembly of said outer and intermediate door panels and said pair of channel members; and second fastener means engageable with said first fastener means to secure said subassembly to said inner door panel.

7. A decorator door assembly as defined in claim 6 and further including a control panel mounted thereon with the bottom of said control panel overlapping and retaining the upper edge of said outer panel and the upper portion of said channel members.

8. A decorator door assembly as defined in claim 6 wherein said first fastener means comprises a plurality of plastic screw grommets for securing said flange means of said subassembly and for receiving said second fastener means.

9. A decorator door assembly as defined in claim 6 wherein said first fastener means comprises a plurality of spring clip fasteners for securing said flange means of said subassembly and for receiving said second fastener means.

10. A decorator door assembly as defined in claim 6 wherein said second fastener means comprises threaded fastener means driven into engagement with said first fastener means from inside said inner door panel to provide a door assembly without fastener means visible from the front or sides of said dishwasher.

11. A door assembly for a dishwasher having a front opening, the combination comprising: an inner door panel for closing said front opening; a decorative outer panel insert; a support panel including forwardly projecting upper and lower generally horizontally extending flange means for vertically aligning and supporting said decorative panel insert on said support panel, said support panel further including a pair of rearwardly projecting generally vertically extending side flanges for spacing said support panel outwardly from said inner door panel, said side flanges including an inwardly turned rear flange portion in a generally vertical plane; substantially vertical side channel means on each side of said support panel including an inwardly turned rear flange means disposed in a generally vertical plane parallel to the plane of said rear flange portion of said support panel side flange means in overlapping and generally mating contact therewith, an imperforate side surface for decoratively covering the edge of said panel insert along with said side flange and the edge of said inner door panel, and an imperforate front lip generally perpendicular to said side surface for overlapping the front surface of said panel insert to decoratively frame and retain said panel insert on said support panel, said side channel means further including an elongated tab member integral with the inside of said side surface and engageable with the lower segment of the side flange of said support panel to lock the lower portion of said side channel means in place; a plurality of plastic screw grommets for securing said mating rear flanges to interlock said side channel means with said support panel and said panel insert in a subassembly; and a plurality of threaded fasteners engageable with said screw grommets for securing said subassembly to said inner door panel.

* * * * *